US011760587B2

(12) United States Patent
Fuse et al.

(10) Patent No.: US 11,760,587 B2
(45) Date of Patent: Sep. 19, 2023

(54) STACKING APPARATUS AND IMAGE FORMING APPARATUS

(71) Applicant: CANON KABUSHIKI KAISHA, Tokyo (JP)

(72) Inventors: Yasuhiko Fuse, Mishima (JP); Shoichi Zensai, Yokohama (JP); Takehito Osada, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 127 days.

(21) Appl. No.: 17/097,972

(22) Filed: Nov. 13, 2020

(65) Prior Publication Data

US 2021/0061595 A1 Mar. 4, 2021

Related U.S. Application Data

(63) Continuation of application No. 16/447,834, filed on Jun. 20, 2019, now Pat. No. 10,865,060, which is a continuation of application No. 15/526,244, filed as application No. PCT/JP2015/005854 on Nov. 25, 2015, now Pat. No. 10,377,589.

(30) Foreign Application Priority Data

Dec. 12, 2014 (JP) ..... 2014-252045

(51) Int. Cl.
*B65H 1/26* (2006.01)

(52) U.S. Cl.
CPC ..... *B65H 1/266* (2013.01); *B65H 2402/51* (2013.01); *B65H 2405/1122* (2013.01); *B65H 2405/121* (2013.01); *B65H 2511/11* (2013.01); *B65H 2511/22* (2013.01)

(58) Field of Classification Search
CPC .... B65H 1/26; B65H 1/266; B65H 2405/112; B65H 2405/1122; B65H 2511/10; B65H 2511/11; B65H 2511/12; B65H 2511/20
See application file for complete search history.

(56) References Cited

U.S. PATENT DOCUMENTS

| | | | | |
|---|---|---|---|---|
| 9,327,924 | B2 * | 5/2016 | Ishikura | B65H 1/266 |
| 9,957,122 | B2 * | 5/2018 | Koga | G03G 15/6552 |
| 10,466,638 | B2 * | 11/2019 | Yamamoto | G03G 15/6567 |
| 2007/0147940 | A1 * | 6/2007 | Hattori | B65H 1/266 400/624 |
| 2007/0196150 | A1 * | 8/2007 | Kobayashi | G03G 15/6502 399/393 |
| 2008/0298873 | A1 * | 12/2008 | Yamagishi | B65H 1/266 400/624 |
| 2010/0270735 | A1 * | 10/2010 | Allwright | B65H 1/266 271/171 |
| 2014/0062012 | A1 * | 3/2014 | Yamamoto | B65H 1/266 271/264 |
| 2017/0121138 | A1 * | 5/2017 | Koga | G03G 15/6502 |

* cited by examiner

*Primary Examiner* — Patrick Cicchino
(74) *Attorney, Agent, or Firm* — CANON U.S.A., INC. IP Division

(57) ABSTRACT

To enable placement of a regulating member which regulates a position of an end of a paper sheet at a desired position, and stable sheet feeding. A fixing member for standard size is guided to engage with a fixing hole for standard size and, in a state where the fixing member for standard size positions a trailing end regulator, a fixing member for non-standard size does not engage with a rack gear.

9 Claims, 24 Drawing Sheets

STACKING APPARATUS AND IMAGE FORMING APPARATUS

CROSS-REFERENCE TO RELATED APPLICATION

This application is a Continuation of U.S. application Ser. No. 16/447,834, filed Jun. 20, 2019, which is a Continuation of U.S. application Ser. No. 15/526,244, filed May 11, 2017, which is a National Stage Entry of PCT/JP2015/005854, filed Nov. 25, 2015, which claims the benefit of Japanese Patent Application No. 2014-252045, filed Dec. 12, 2014, which are hereby incorporated by reference herein in their entirety.

TECHNICAL FIELD

The present invention relates to a stacking apparatus and an image forming apparatus.

BACKGROUND ART

In widely used electrophotographic image forming apparatuses, for example, a paper sheet is conveyed to an image forming unit where an image is formed on the paper sheet. An image forming apparatus of this type typically includes a device to detachably attach a paper sheet stacking tray to the image forming apparatus body, and automatically carry a paper sheet stored in the paper sheet stacking tray to the image forming unit. The paper sheet stacking tray used in an image forming apparatus of this type can store paper sheets of various sizes in a single tray. Specifically, an image forming apparatus of this type includes a trailing end regulating device that regulates an upstream side of the paper sheet in the conveying direction, and a width regulating device that regulates a position of the paper sheet in the width direction crosses perpendicularly the conveyance direction, in a manner such that the positions thereof can be changed depending on the size of the placed paper sheet.

Various sizes of the paper sheets typically are paper sheets of predetermined sizes defined by the standards (hereafter, referred to as paper of standard size). For example, paper sheets of standard sizes such as DIN-A4, DIN-A3, 8.5×11 inches, and 11×17 inches, and paper sheets out of these standard sizes (hereafter, referred to as paper of non-standard size) are used widely.

A user who uses these various paper sheets may place a paper sheet on a paper sheet stacking tray after fixing the width regulating device and the trailing end regulating device at predetermined positions, or place a paper sheet in advance on the paper sheet stacking tray, and fix the width regulating device and the trailing end regulating device depending on the size of the paper sheet.

In an apparatus in which paper of standard size is used, in order to make the user easily operate the width regulating device and the trailing end regulating device, labels or stamps may be provided at positions corresponding to the sizes of the paper of standard size to indicate desired positions of the regulating device. Further, clicking and the like at the time of regulating the device operation may indicate that the regulating device is located at a desired position.

However, in a case where the paper of standard size is used, even if a width regulating device by a user, or a configuration to make an operation of the trailing end regulating device easy is provided, the operation thereof is not necessarily made as intended by the user. That is, since different users interpret visually aligning the position of the regulating device with indication, such as a label and a stamp, or clicking at the time of operating the regulating device slightly differently from one another, a case in which the regulating device is fixed while being shifted slightly from a desired position is also known.

For example, if the trailing end regulating device is placed at a position at which the length of the paper sheet in the longitudinal direction from the desired position is reduced, the paper sheet is pressed by the regulating device more than necessary, and the leading end and the trailing end of the paper sheet becomes closer to each other. This causes the following problems: the paper sheets are not lifted by a swing type lift plate due to friction between the leading end of the paper sheet and a wall of an end of the tray; or paper feeding failure is caused by lift pressure loss.

If the trailing end regulating device is placed at a position at which the length of the paper sheet in the longitudinal direction from the desired position is increased, the leading end position of the paper sheet on the paper sheet stacking tray may also be changed from the desired position and, therefore, the relative position between the leading end position of the paper sheet and the feed roller which conveys the paper sheet may be changed. This may cause paper feeding failure such as failure in conveyance.

Then, as disclosed in PTL 1, a fixing position of paper of standard size is made noticeable by removing a positioning shape of a trailing end regulating device at a boundary between a position corresponding to paper of standard size and a position corresponding to paper of non-standard size to help a user easily find an ideal position for the trailing end regulating device when using paper of standard size. In the configuration of PTL 1, however, there has been a case where the trailing end regulating device is positioned by neither a positioning mechanism for standard size nor a positioning mechanism for non-standard size near the position corresponding to paper of standard size. If the trailing end regulating device is used while being shifted slightly, the position of the regulating device is not fixed at the region where positioning shape of the regulating device has been removed. Therefore, the following problems may be caused: the position of the regulating device is changed while the paper sheet is being fed and, thereby, sheet skew may be caused.

CITATION LIST

Patent Literature

[PTL 1] Japanese Patent Application No. 2006-43747

SUMMARY OF INVENTION

The present invention provides a stacking apparatus and an image forming apparatus capable of placing a regulating device at a desired position and stably feeding paper sheets.

A stacking apparatus including: a sheet stacking unit on which paper sheets are stacked; a regulating member which is provided to be movable in a first direction and a second direction opposite to the first direction relative to the sheet stacking unit, and regulates a position of an end of the paper sheet; a first engaging portion provided in the regulating member; a second engaging portion provided in the regulating member; a first portion to be engaged which is provided in the sheet stacking unit and positions the regulating member at a position corresponding to a paper sheet of standard size by engaging with the first engaging portion;

a second portion to be engaged which is provided in the sheet stacking unit and positions the regulating member at a position corresponding to a paper sheet of non-standard size by engaging with the second engaging portion; a first guiding portion configured to guide the first engaging portion, which is distant from the first portion to be engaged in a range of a first predetermined distance in the first direction, to engage with the first portion to be engaged; and a second guiding portion configured to guide the first engaging portion, which is distant from the first portion to be engaged in a range of a second predetermined distance in the second direction, to engage with the first portion to be engaged, wherein the second engaging portion does not engage with the second portion to be engaged in a state where the distance of the first engaging portion from the first portion to be engaged in the first direction is within the range of the first predetermined distance, and the second engaging portion does not engage with the second portion to be engaged in a state where the distance of the second engaging portion from the second portion to be engaged in the second direction is within the range of the second predetermined distance.

Further features of the present invention will become apparent from the following description of exemplary embodiments with reference to the attached drawings.

DESCRIPTION OF EMBODIMENTS

First Embodiment

Figure 4:
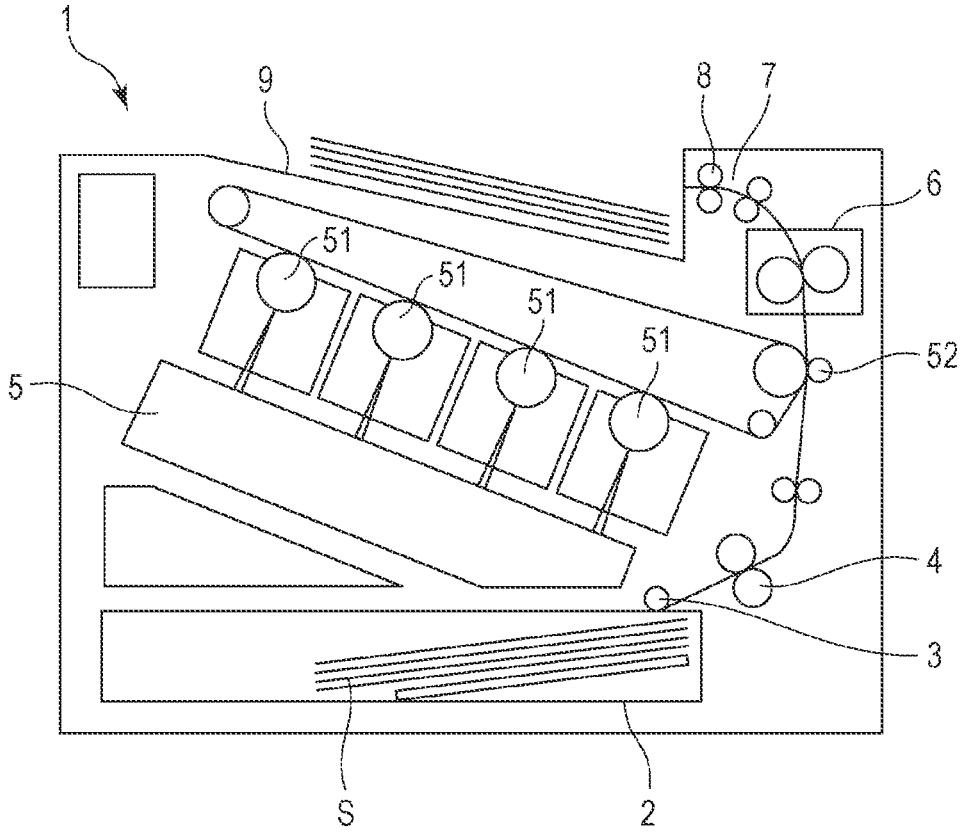
FIG. 4 is a cross-sectional view of the entire configuration of the image forming apparatus body.

FIG. 4 is a schematic cross-sectional view illustrating the entire configuration of an image forming apparatus. An image forming apparatus 1 forms an image by an electrophotographic recording method, in which a paper sheet (i.e., a recording material) S is conveyed to an image forming unit where a toner image is transferred, the paper sheet S is conveyed to a fixing unit where the toner image is fixed, and then the paper sheet S is discharged to a discharge unit.

The paper sheets S are stacked and stored in a cassette 2 which is a paper sheet storing unit (i.e., a paper sheet stacking tray) attached at a lower portion of the apparatus. The paper sheet S is fed out sequentially one at a time from the top sheet by a feed roller 3 which is a sheet feeding unit, and is sent to the image forming unit by a conveyance roller pair 4. The image forming unit includes photosensitive drums 51, a laser scanner 5 that writes an image on the photosensitive drum 51, and a transfer roller 52 that transfers a toner image formed on the photosensitive drums 51 to a recording material via an endless belt. These well-known configurations are not described in detail.

The paper sheet S having an unfixed toner image thereon is conveyed to a fixing unit 6. While the paper sheet S passes through a fixing nip portion, the toner image is heated and fixed. The paper sheet S is then discharged outside the apparatus by a discharge roller pair 8 via a paper sheet discharge path 7, and is stacked on a discharge tray 9.

Figure 2:
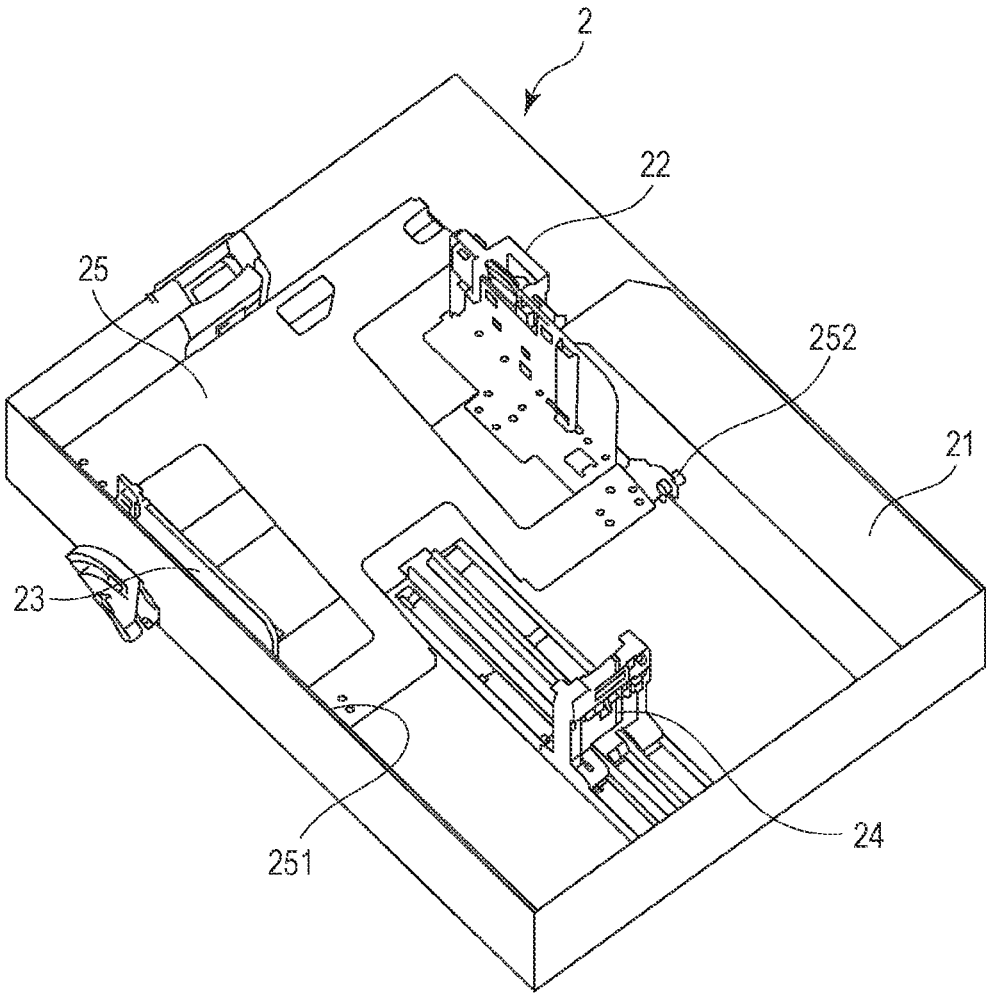
FIG. 2 is a perspective view of a schematic structure of a cassette provided in an image forming apparatus.

Next, a detailed configuration of the cassette 2 as a stacking apparatus mounted in the image forming apparatus 1 is described with reference to FIGS. 2 to 3. FIG. 2 is a perspective view of a schematic structure of the cassette 2 capable of storing the paper sheets S of various sizes.

The cassette 2 illustrated in FIG. 2 is provided with a cassette main body 21 that stores the paper sheets of various sizes by stacking thereon, and paper sheet end regulating devices that regulate ends of the paper sheets. The paper sheet end regulating devices consist of a pair of width regulating devices 22 and 23 that regulate a paper end position in the width direction which perpendicular crosses the paper sheet conveyance direction, and a trailing end regulating device 24 that regulates the trailing end position of the paper sheet. The cassette 2 further includes an intermediate plate (i.e., a sheet stacking unit) 25 of the paper sheet stacking unit that pivots about intermediate plate shafts 251 and 252 and urges the stacked paper sheets toward the feed roller. The width regulating devices 22 and 23 and the trailing end regulating device 24 are disposed at positions not to be affected by the pivotal operation of the intermediate plate 25. The upstream side of the paper sheet is supported also by a portion upstream of the intermediate plate 25 (i.e., the sheet stacking unit).

Figure 3:
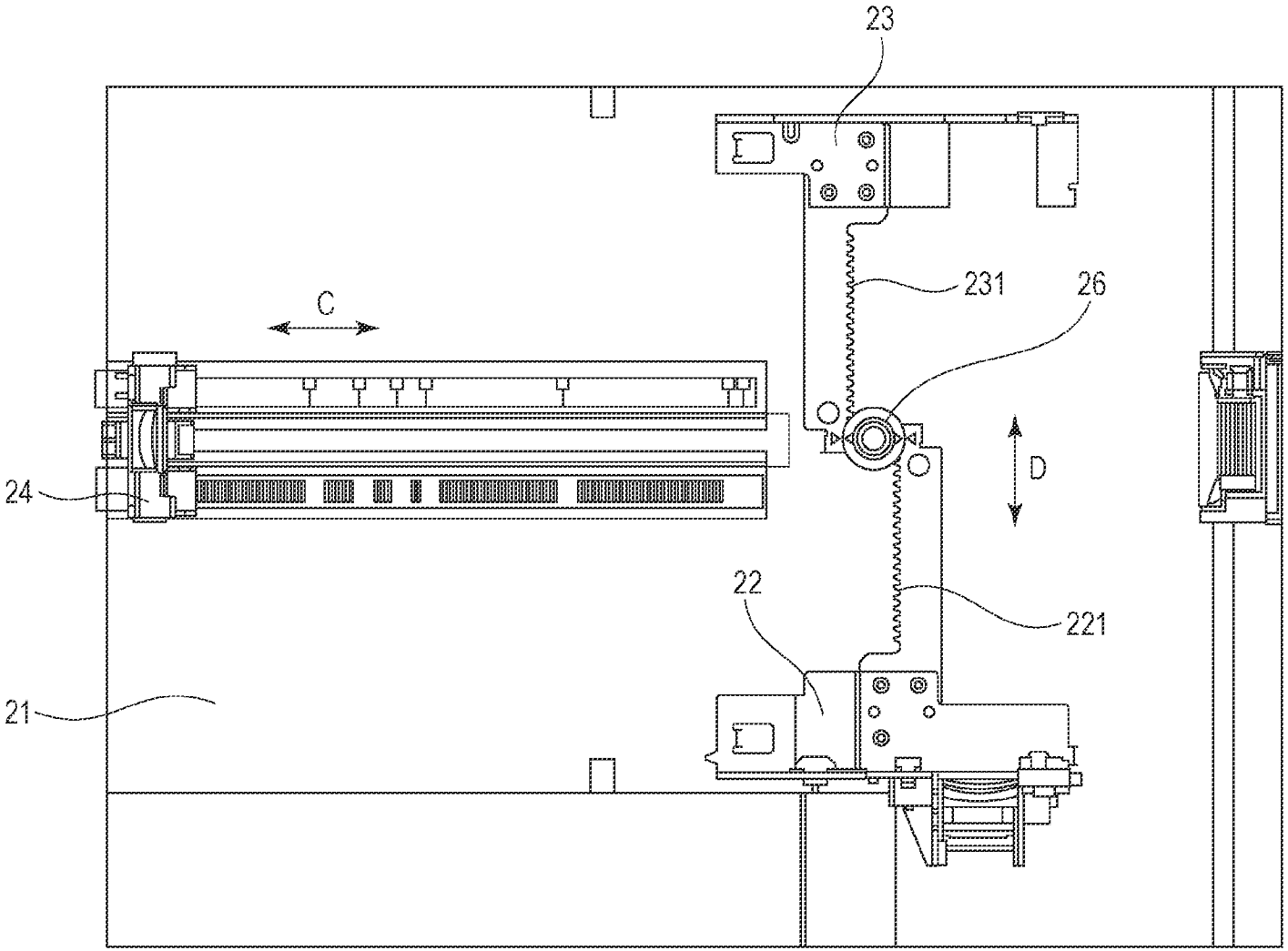
FIG. 3 is a plan view of a schematic structure of the cassette provided in the image forming apparatus.

FIG. 3 is a plan view of the cassette 2 seen from above. The pair of width regulating devices 22 and 23 each have rack teeth formed in rack portions 221 and 231 extending in the width direction of the paper sheet (i.e., the direction of arrow D). A pinion 26 meshes with the rack teeth. With this configuration, when any one of the width regulating devices is moved in the width direction, the other of the width regulating devices cooperates with the interaction between the pinion 26 and the rack portions 221 and 231 and moves in the opposite direction to that of the one of the width regulating devices. Positioning of the width regulating devices 22 and 23 is performed by using an unillustrated groove formed in the cassette main body 21, and unillustrated fixing units provided in the width regulating devices 22 and 23.

The trailing end regulating device (i.e., a regulating member) 24 is movable in a paper sheet feeding direction (i.e., a first direction) and the opposite direction (i.e., a second direction) along a guide groove provided in the direction of arrow C in a bottom plate of the cassette main body 21. In the same manner as in the width regulating devices 22 and 23, positioning of the trailing end regulating device 24 is performed by using an unillustrated groove formed in the cassette main body 21, and an unillustrated fixing unit provided in the trailing end regulating device 24.

Figure 1:
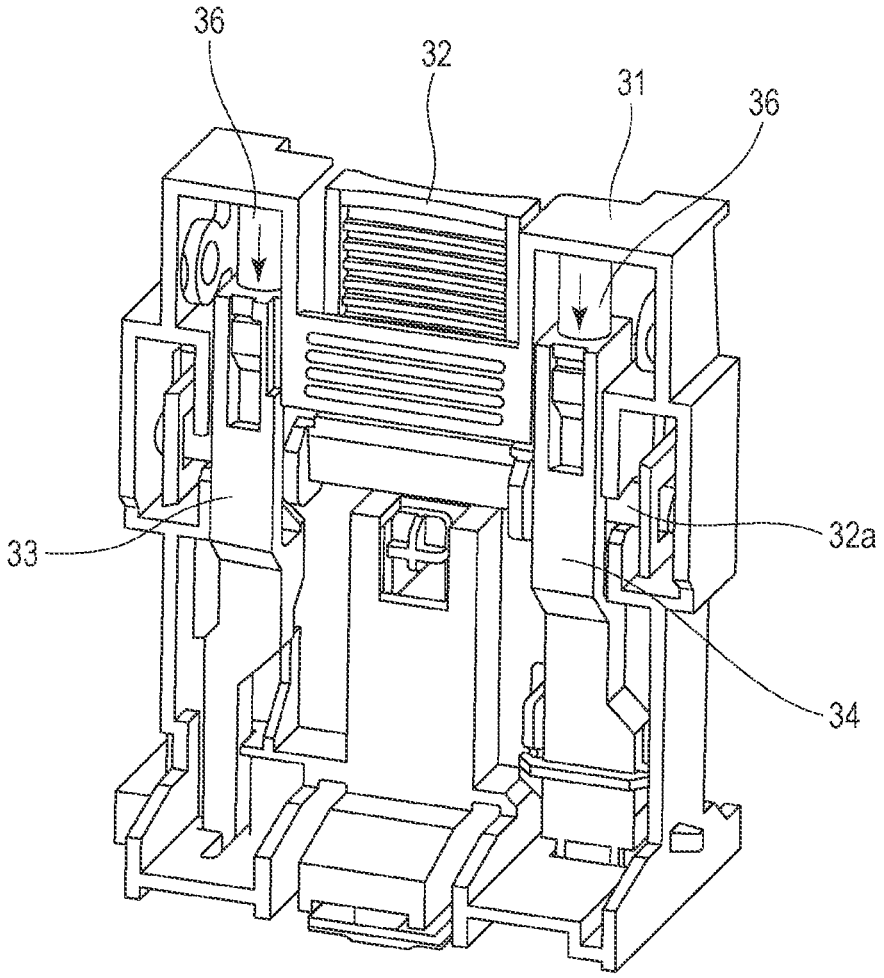
FIG. 1 is a perspective view of a first embodiment of a trailing end regulating device according to the present invention.

Here, a configuration of the trailing end regulating device 24 in the first embodiment is described in detail. FIG. 1 is a perspective view of the trailing end regulating device (hereafter, referred to as a trailing end regulator) 24 in the first embodiment.

In a trailing end regulator case (i.e., a holding member) 31 that forms a frame holding each component in the trailing end regulator 24, an operation lever 32 as an operation member is pivotally held about a pivotal shaft (i.e., a pivotal axis) 32*a* to be pivotable between a retracted position and an operative position. When a user operates the operation lever 32 located at the retracted position to pivot to the operative position, the position of the trailing end regulator 24 in the cassette 2 can be moved. When the user releases his/her hand from the operation lever 32, the operation lever 32 pivots from the operative position to the retracted position, and the position of the trailing end regulator 24 is fixed. A rod-shaped member is provided at each of the both end portions of the pivotal shaft 32*a* of the operation lever 32. One of the rod-shaped members is a fixing member for standard size (i.e., a first engaging member) 33 that fixes the trailing end regulator 24 at a position for standard size, and another is the fixing member for non-standard size (i.e., a second engaging member) 34 that fixes the trailing end regulator 24 at a position for non-standard size. The fixing member for standard size 33 and the fixing member for non-standard size 34 engage with the operation lever 32.

Figure 5:
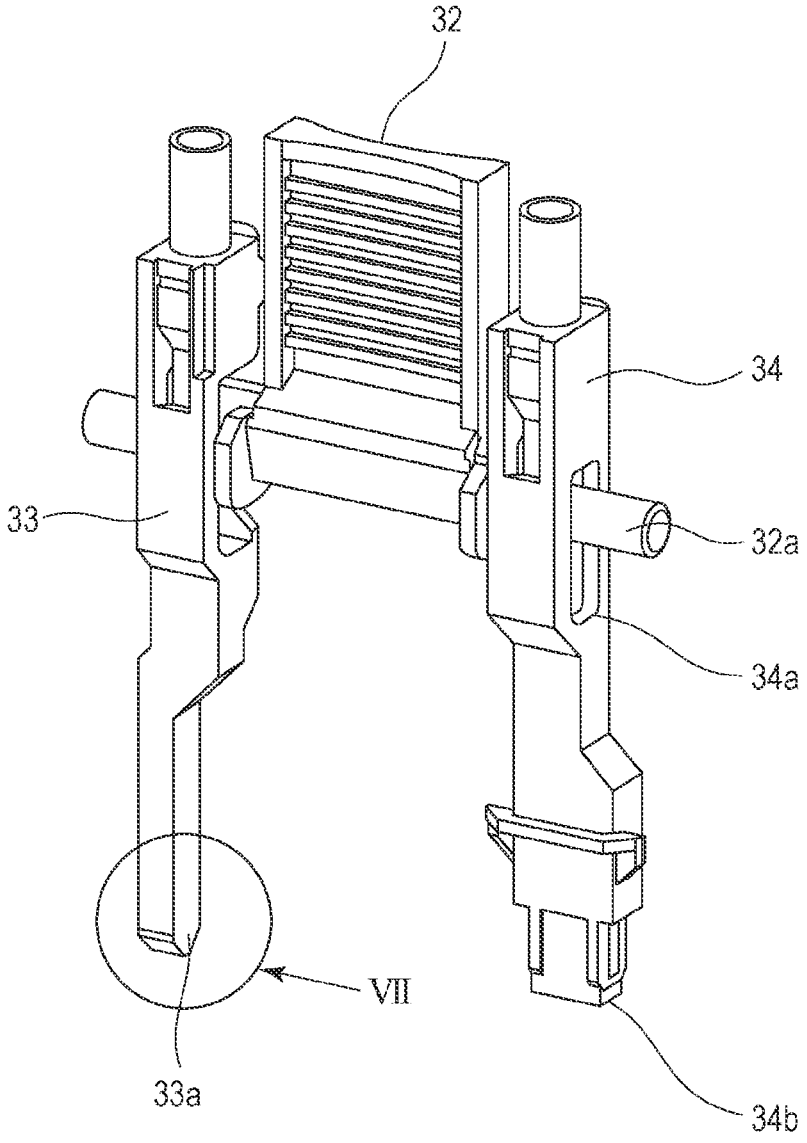
FIG. 5 is a perspective view illustrating an engagement configuration between an operation lever of a trailing end regulator and two fixing members.

An engagement relationship among the operation lever 32, the fixing member for standard size 33, and the fixing member for non-standard size 34 (these fixing members are referred to as "two fixing members" hereafter) is exclusively illustrated in FIG. 5 for the ease of description. The fixing member for non-standard size 34 is held to be movable upward and downward within the trailing end regulator case 31 with the pivotal shaft 32*a* of the operation lever 32 penetrating a substantially elongated round hole 34*a*. The fixing member for standard size 33 and the operation lever 32 engage with each other in the same manner.

Figure 6A:
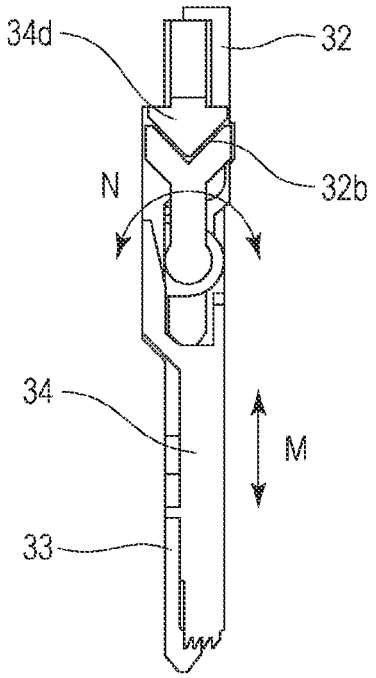
FIG. 6A is a cross-sectional view illustrating an engagement configuration between the operation lever of the trailing end regulator and the two fixing members.
Figure 6B:
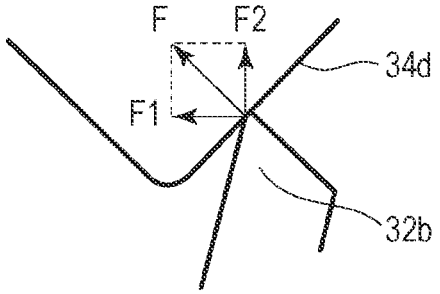
FIG. 6B is an enlarged view of a sliding portion.

A cross-sectional shape of the engaging portion of the two fixing members and the operation lever 32 is illustrated in FIG. 6A. Since the fixing member for standard size 33 and the fixing member for non-standard size 34 are held by the trailing end regulator case 31, these fixing members can be moved only in the direction of arrow M (i.e., the vertical direction). The operation lever 32 is pivotable in the direction of arrow N about the shaft 32*a*. A V-shaped tip 32*b* of the operation lever 32 pivots while sliding against a slope 34*d* of the fixing member for non-standard size 34. FIG. 6B is an enlarged view of the sliding portion. As the operation lever 32 pivots, the V-shaped tip 32*b* urges the slope 34*d* in the direction of arrow F which is the vertical direction. Among F1 and F2 which are force components in the direction of arrow F, the two fixing members are moved by the force of the direction F2 in which two fixing members can be moved. Then pivotal movement of the operation lever 32 is converted into vertical movement of the fixing member for standard size 33 and the fixing member for non-standard size 34. That is, the tip 32*b* of the operation lever 32 and the slope 34*d* of the fixing member for non-standard size 34 function as a first release mechanism and a second release mechanism that move the fixing member for standard size 33 and the fixing member for non-standard size 34 between an engagement position and a release position.

Figure 7:
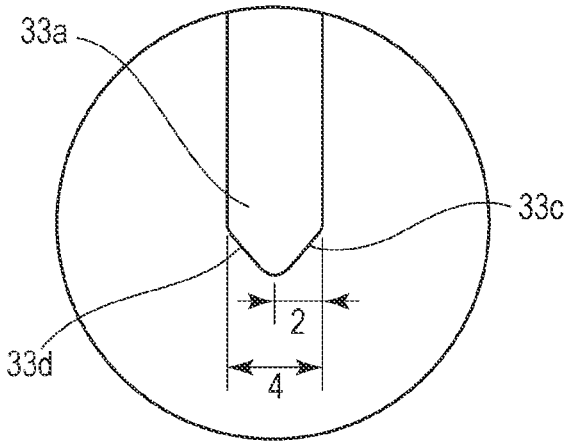
FIG. 7 is an enlarged view illustrating a tip shape of a fixing member for standard size.

As illustrated in FIG. 5, a tip (i.e., a first engaging portion) 33*a* of the fixing member for standard size 33 has a slope 33*a* in the same direction as that in which the trailing end regulator 24 moves. FIG. 7 is an enlarged view of a portion seen from the direction of arrow VII. Since both sides in the sheet conveying direction are sloped, the tip has a substantial triangular shape. In the present embodiment, the width of the fixing member for standard size 33 in the sheet conveying direction is 4 mm, and each slope is 2 mm.

As illustrated in FIG. 6A, a tip (i.e., second engaging portion) 34*b* of the fixing member for non-standard size 34 has a plurality of gear teeth. Therefore, as the fixing member for non-standard size 34 moves upward and downward in the trailing end regulator case 31, the tip 34*b* is capable of moving close to or apart from, or engaging with rack gears 43 described later (see FIG. 13) provided in the cassette 2. The relationship between the two fixing members and the cassette 2 moving close to or apart from, or engaging with each other is described in detail later.

Figure 8:
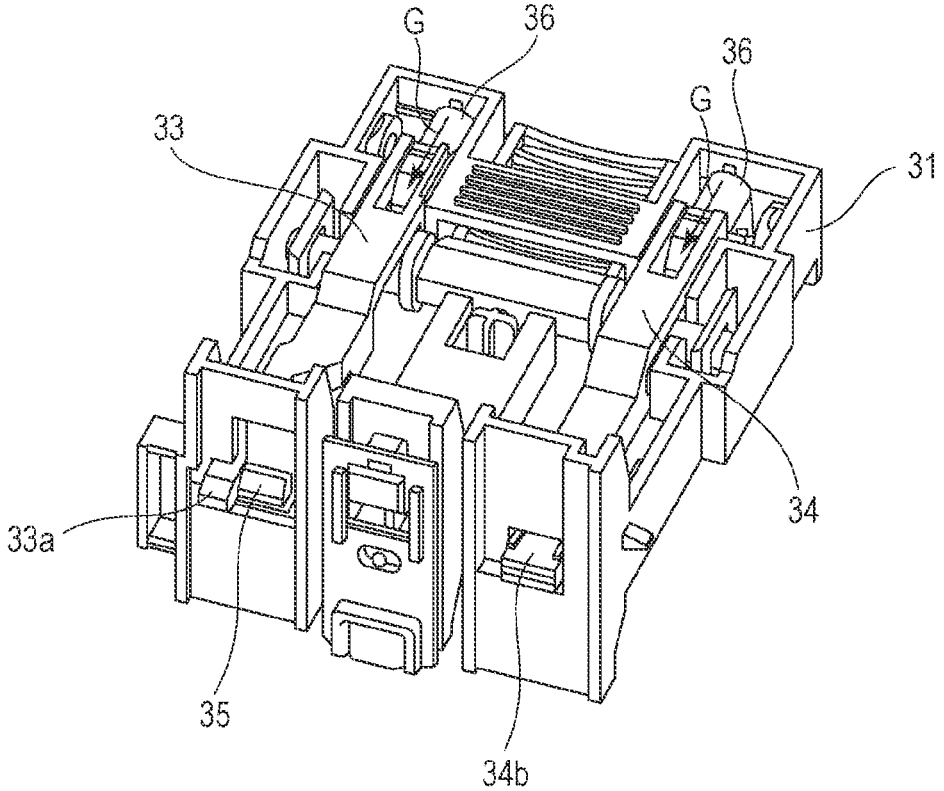
FIG. 8 is a perspective view illustrating an engaging portion of the trailing end regulator with the cassette.

FIG. 8 is a perspective view of the trailing end regulator 24 seen from below of FIG. 1.

The trailing end regulator case 31 includes a claw 35 for clicking to notify the user that the trailing end regulator 24 is located at a predetermined position for standard size. An elastic member, such as a compression spring, is disposed on the back side of the claw so that click feeling becomes constant as much as possible.

Figure 9A:
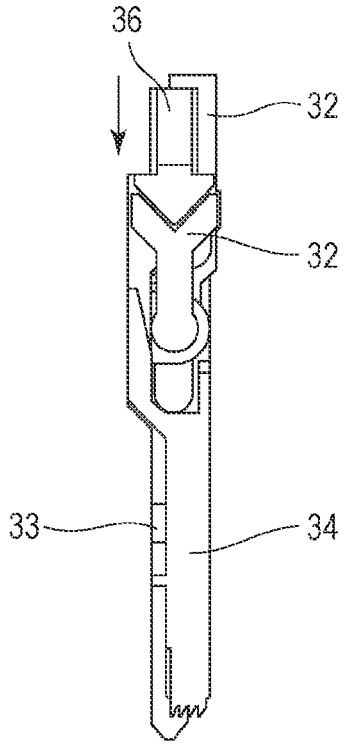
FIG. 9A is a cross-sectional view illustrating an operating state of the operation lever of the trailing end regulator and a fixing portion.

As illustrated in FIG. 8, each of the fixing member for standard size 33 and the fixing member for non-standard size 34 is provided with an elastic member 36, such as a compression spring, on the upper side thereof. The elastic member 36 elastically urges the two fixing members in the direction of arrow G in FIG. 8 (i.e., downward in the vertical direction). Therefore, as illustrated in FIG. 9A, when the trailing end regulator 24 is fixed within the cassette 2 (i.e., a state where the user releases his/her hand from the operation lever 32), the operation lever 32 is generally located at its upright position (i.e., a first lever position). When the user makes the operation lever 32 to pivot to move the trailing end regulator 24, in cooperation with the pivot of the operation lever 32, the fixing member for standard size 33 and the fixing member for non-standard size 34 move upward in the vertical direction against the elastic force of the elastic member 36 (i.e., a second lever position).

Figure 10:
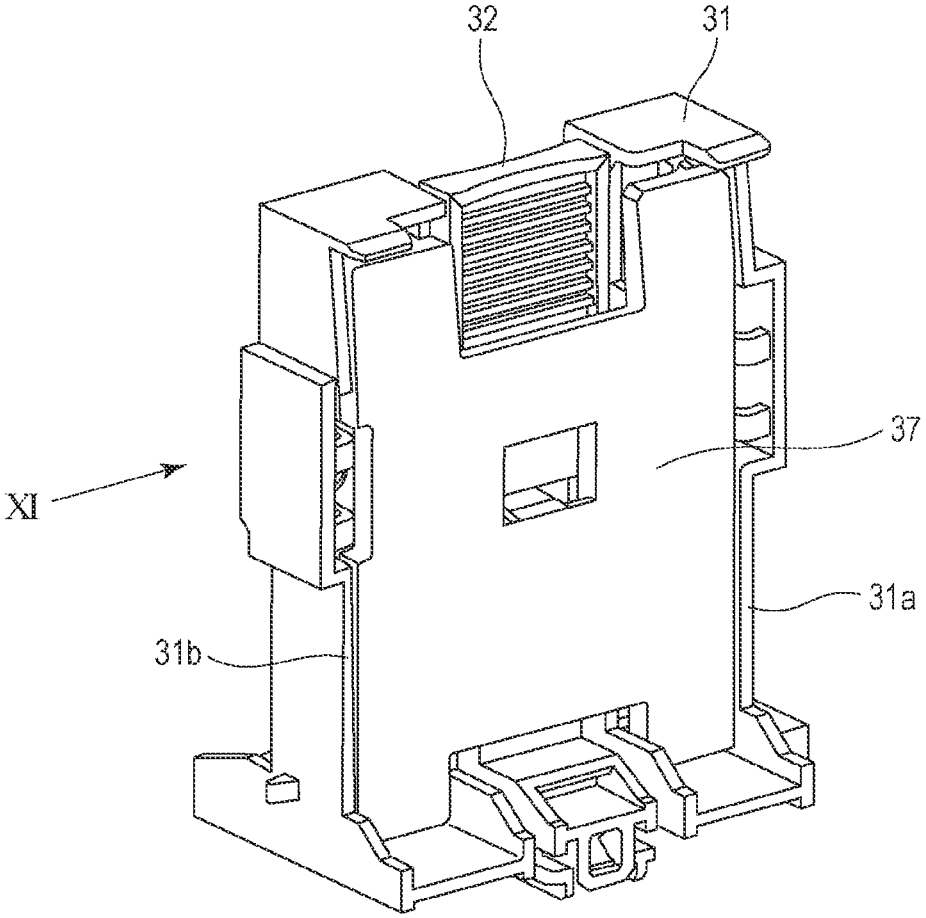
FIG. 10 is a perspective view illustrating a configuration on the side of a contact surface of the trailing end regulator with a paper sheet.

As illustrated in FIG. 10, a flap plate (i.e., a pressing member) 37 is provided in the trailing end regulator 24 on the side on which the trailing end regulator 24 touches paper sheet ends. The flap plate 37 is held by the trailing end regulator case 31 to be pivotable about a pivotal axis. The flap plate 37 is elastically urged by an unillustrated elastic member in the direction to approach the paper sheet, and is swingably held relative to the trailing end regulator case 31 in a first movable range against elastic force of the elastic member. The trailing end regulator case 31 is provided with nominal surfaces 31*a* and 31*b* which receive the paper sheet ends.

Figure 11A:
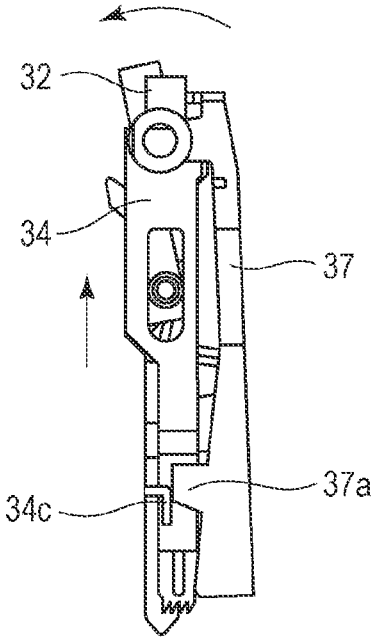
FIG. 11A is a cross-sectional view illustrating an engaging portion between a fixing member for non-standard size and a flap plate.
Figure 11B:
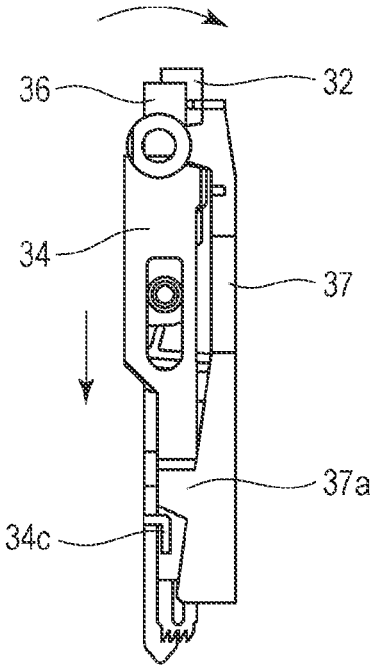
FIG. 11B is a cross-sectional view illustrating the engaging portion between the fixing member for non-standard size and the flap plate.

An engagement relationship between the flap plate 37 and the fixing member for non-standard size 34 is described with reference to FIGS. 11A and 11B. FIGS. 11A and 11B are each side view of FIG. 10 seen from the direction of arrow XI, in which the trailing end regulator case 31 is not illustrated. The flap plate 37 has a rib-shaped projection 37*a* capable of moving close to or apart from, or engaging with the fixing member for non-standard size 34. As illustrated in FIG. 11A, when the operation lever 32 is located at the operative position and the fixing member for non-standard size 34 is located at the second lever position, the projection 37*a* of the flap plate 37 interferes with an engagement wall 34*c* of the fixing member for non-standard size 34. Therefore, the flap plate 37 is fixed while projecting at a predetermined amount from the nominal surfaces 31*a* and 31*b* illustrated in FIG. 10 without being sufficiently accommodated in the trailing end regulator case 31 (this state is referred to as a locked state of the flap plate 37). That is, movement of the flap plate 37 relative to the trailing end regulator case 31 is regulated. According to the first embodiment, the trailing end regulator 24 is prevented from being excessively urged against the paper sheets by regulating the range of movement of the flap plate 37 in the state where the operation lever 32 is operated by the user.

Figure 12:
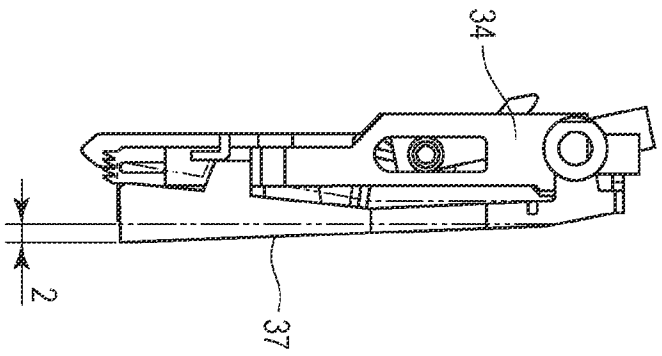
FIG. 12 is a cross-sectional view illustrating a projection amount when the flap plate is locked.

When the user finishes operation of the trailing end regulator 24 and releases his/her hand from the operation lever 32 as illustrated in FIG. 11B, the operation lever 32 pivots to the retracted position, and the fixing member for non-standard size 34 returns to the first lever position by the urging force of the elastic member 36. Therefore, engagement between the flap plate 37 and the fixing member for non-standard size 34 is released, and the flap plate 37 becomes pivotable to the same surface as the nominal surfaces 31*a* and 31*b*. In FIG. 12, the flap plate 37 is illustrated in the first lever position and the second lever position in FIGS. 11A and 11B in the overlapped manner, in which the locked state of the flap plate 37 is illustrated by the solid line, and a state where engagement of the flap plate 37 is released is illustrated by the dashed line. In the first embodiment, in the locked state of the flap plate 37, a projection amount of the flap plate 37 from the position of the nominal surfaces 31*a* and 31*b* is set to 2 mm.

Next, a configuration to position, with respect to the cassette 2, the trailing end regulator 24 which is movable relative to the cassette 2 is described.

Figure 13:
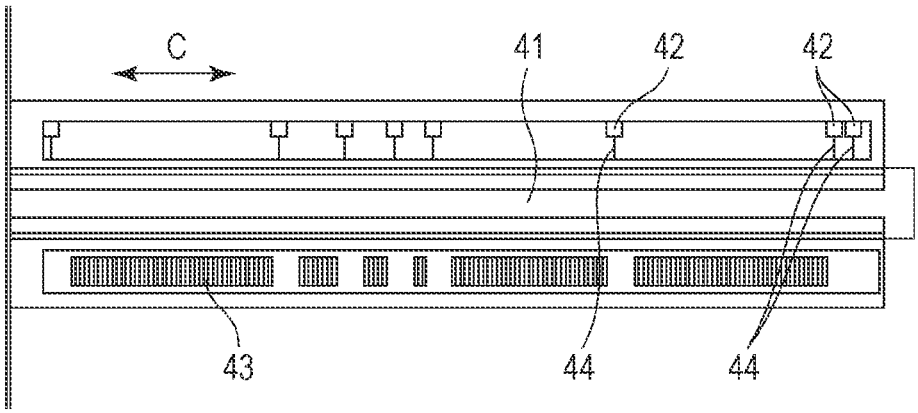
FIG. 13 is a plan view illustrating a shape of engaging portions of the cassette with the trailing end regulator.

FIG. 13 is an enlarged plan view of a portion at which two fixing members of the cassette 2 are engaging. The trailing end regulator 24 is provided in the direction of arrow C to be movable along a guide groove 41. As illustrated in FIG. 13, the cassette 2 includes holes or grooves according to a predetermined rule in parallel to the paper sheet feeding direction.

A plurality of fixing holes for standard size (i.e., first portions to be engaged) 42 for fixing the paper sheet of standard size are provided at locations corresponding to nominal positions according to each sheet size defined by the standard. Each of the fixing holes for standard size 42 is a 4 mm×4 mm square through hole in the first embodiment.

Click grooves 44 are disposed to engage with claws provided in the trailing end regulator case 31 to notify the user that the trailing end regulator 24 has moved to the position corresponding to the standard size. Since the click grooves 44 indicate that the trailing end regulator 24 is located at the position for standard size, a plurality of click grooves 44 are disposed at the same intervals as that of the fixing holes for standard size 42.

Figure 14:
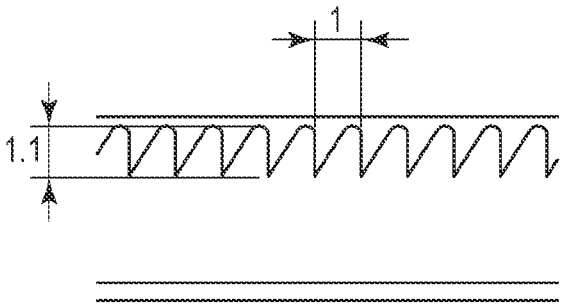
FIG. 14 is an enlarged sectional view illustrating a rack shape of the cassette.

The rack gears (i.e., a second portion to be engaged) 43 are provided according to a constant rule to engage tip gear teeth of the fixing member for non-standard size 34. FIG. 14 is a partial cross-sectional view of the rack gear 43, of which gear teeth are arranged according to a constant rule at the depth of about 1.1 mm and at the pitch of 1 mm in the first embodiment.

As described above, the fixing holes for standard size 42, the rack gears 43, and the click grooves 44 are arranged in parallel with the direction in which the trailing end regulator 24 moves.

Next, a state where the trailing end regulator 24 is fixed at the position corresponding to the paper sheet of standard size and a state where the trailing end regulator 24 is fixed at the position corresponding to the paper sheet of non-standard size are described.

Figure 9B:
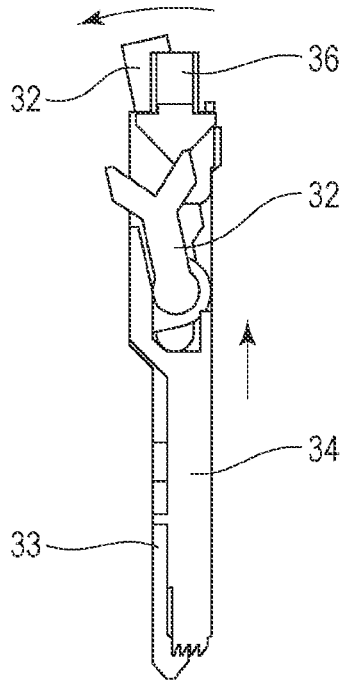
FIG. 9B is a cross-sectional view illustrating an operating state of the operation lever of the trailing end regulator and the fixing portion.
Figure 15A:
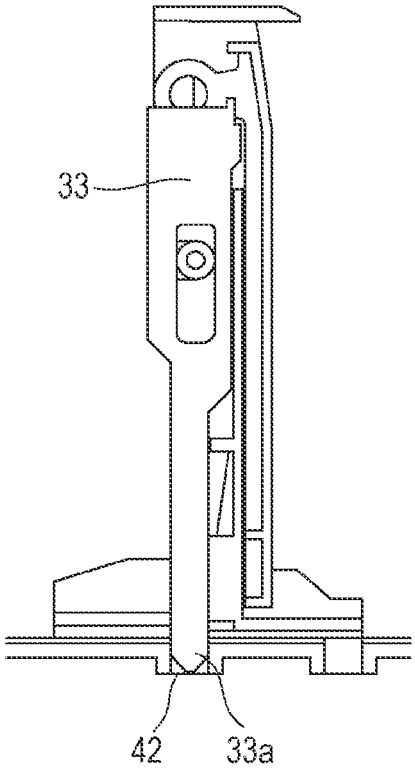
FIG. 15A is a cross-sectional view illustrating an engaging portion of the trailing end regulator with the cassette at a standard size position.
Figure 15B:
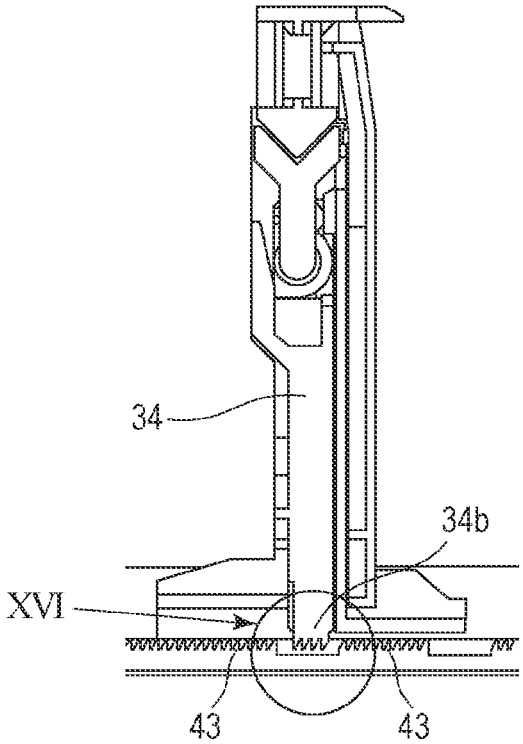
FIG. 15B is a cross-sectional view illustrating an engaging portion of the trailing end regulator with the cassette at the standard size position.
Figure 16:
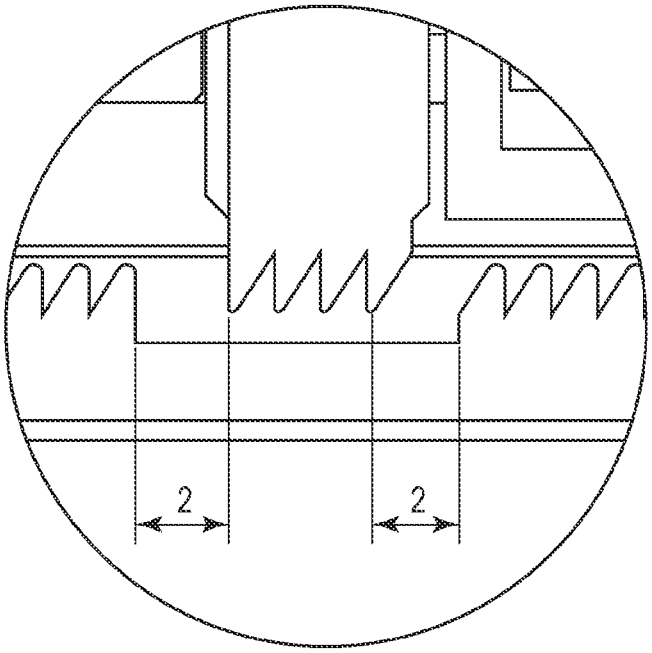
FIG. 16 is a cross-sectional view illustrating a gap between the fixing member for non-standard size and a rack of the cassette at the standard size position.

FIGS. 15A and 15B illustrate a state where the trailing end regulator 24 is fixed at the position corresponding to the standard size (i.e., a first engaging position). In this state, the tip 33*a* of the fixing member for standard size 33 fits into the fixing hole for standard size 42 of the cassette 2 so that the trailing end regulator 24 is fixed and held not to move in the conveyance direction of the paper sheet and the opposite direction thereof. A tip 34*b* of the fixing member for non-standard size 34 is located in a region in which no rack gear 43 of the cassette 2 exists, and is held with a gap between the cassette 2. That is, in the vicinity of the position corresponding to the standard size, the cassette 2 has no gear tooth of the rack gear 43. As illustrated in FIGS. 9A and 9B, the two fixing members are urged downward by the elastic member 36, engage with the V-shaped tip 32*b* of the operation lever 32, whereby the position in the up-down directions is defined. FIG. 16 is an enlarged view of the tip 34*b* of the fixing member for non-standard size 34. A gap between a plurality of gear teeth of the fixing member for non-standard size 34 and the rack gear 43 of the cassette 2 is about 2 mm in the first embodiment. This means that, in the first embodiment, the fixing member for non-standard size 34 does not engage with the rack gear 43 of the cassette 2 when the trailing end regulator 24 is located in a range of ±2 mm from the nominal position of the standard size in the conveyance direction of the paper sheet.

Figure 17A:
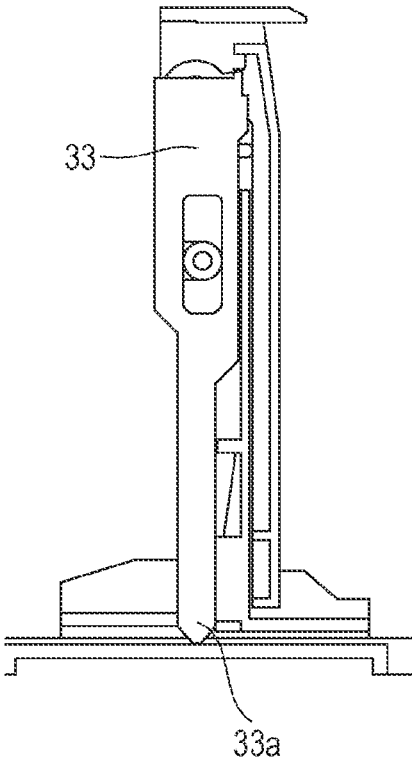
FIG. 17A is a cross-sectional view illustrating an engaging portion between the trailing end regulator and the cassette at a non-standard size position.
Figure 17B:
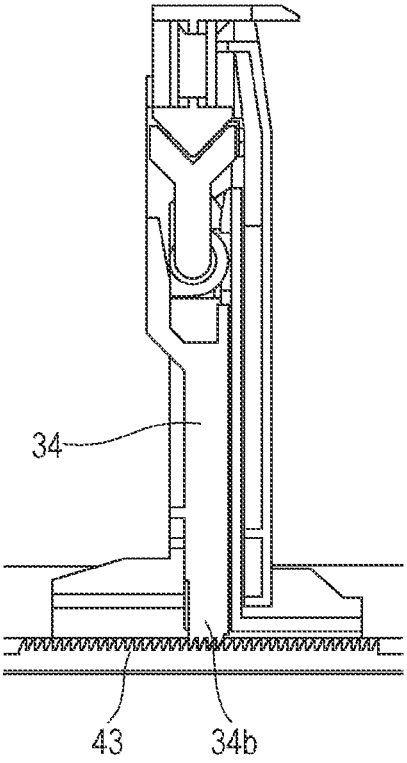
FIG. 17B is a cross-sectional view illustrating an engaging portion between the trailing end regulator and the cassette at the non-standard size position.

FIGS. 17A and 17B illustrate a state where the trailing end regulator 24 is fixed at a position for non-standard size (i.e., a second engaging position). The tip 33*a* of the fixing member for standard size 33 is held in contact with a flat portion of the cassette 2 (i.e., a region where no fixing hole for standard size 42 exists). That is, since the fixing member for standard size 33 does not fit into the fixing hole for standard size 42 of the cassette 2, the force to hold the position of the trailing end regulator 24 is not generated in this configuration. The tip 34*b* of the fixing member for non-standard size 34, on the other hand, engages with the rack gear 43 of the cassette 2, thereby generating the force to hold the position of the trailing end regulator 24.

Hereinafter, a mechanism for guiding the trailing end regulator 24 to the desired nominal position when the trailing end regulator 24 is placed with its position being shifted slightly from the nominal position (i.e., the position corresponding to the standard size) is described. According to the first embodiment, the trailing end regulator 24 can be prevented from being incorrectly placed at a position near the position corresponding to the standard size, and the user can place the trailing end regulator 24 at the position for standard size reliably. This placement is described below.

Figure 18A:
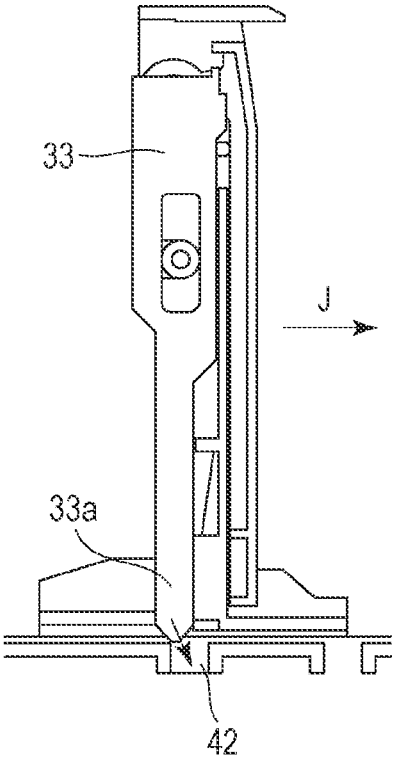
FIG. 18A is a cross-sectional view for illustrating a mechanism for moving the trailing end regulator to a nominal position.
Figure 18B:
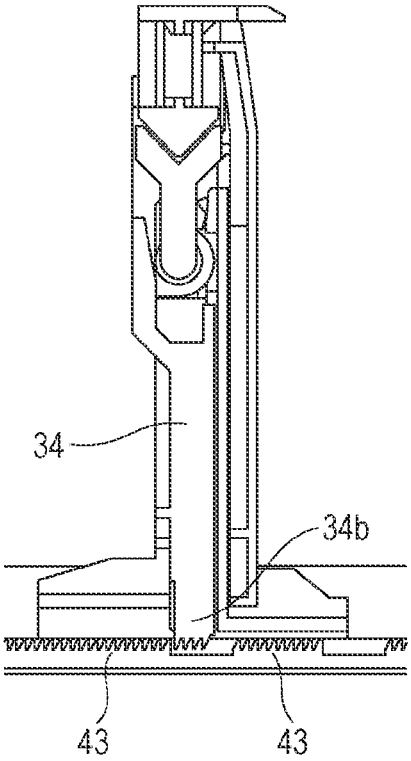
FIG. 18B is a cross-sectional view for illustrating the mechanism for moving the trailing end regulator to the nominal position.
Figure 19:
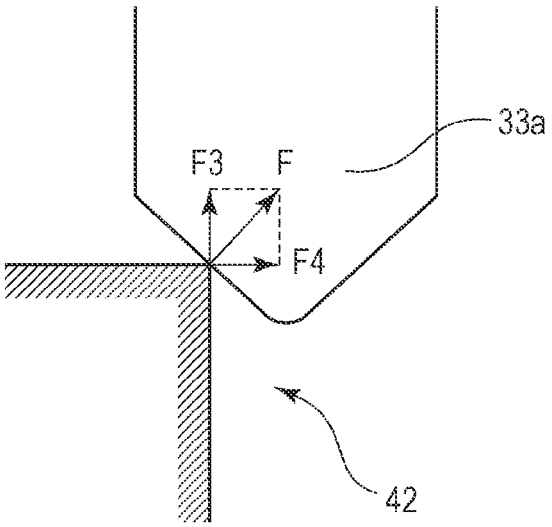
FIG. 19 is an enlarged view for illustrating the mechanism for moving the trailing end regulator to the nominal position.

First, a case where the paper sheet is placed after the position of the trailing end regulator 24 is determined is described. FIGS. 18A and 18B illustrate a case where the user has finished the positioning of the trailing end regulator 24 at a position shifted by 1.5 mm from the nominal position in the longitudinal direction of the paper sheet. As illustrated in FIGS. 18A and 18B, the tip 33*a* of the fixing member for standard size 33 is located at a position shifted from the fixing hole for standard size 42 of the cassette 2. At this time, the fixing member for standard size 33 is urged downward in FIGS. 18A and 18B by the elastic member 36. Since the tip 33*a* of the fixing member for standard size 33 is a slope as described above, the tip 33*a* tries to fit into the fixing hole for standard size 42 in response to urging force of the elastic member. At the same time, force to move the entire trailing end regulator 24 in the direction of arrow J acts in response to reaction force from the slope. FIG. 19 is an enlarged view of the tip 33*a* of the fixing member for standard size 33 and the fixing hole for standard size 42. A force component of reaction force F from the slope causes the force in the direction F4 to move the entire trailing end regulator 24 in the direction J in FIG. 18A. Therefore, the tip 33*a* is guided to engage with the fixing hole for standard size 42.

As illustrated in FIG. 16, the tip 34*b* of the fixing member for non-standard size 34 and the rack gear 43 of the cassette 2 are in a positional relationship not to engage with each other. Therefore, it is not disturbed that the trailing end regulator 24 is guided to the desired position of the standard size. According to the first embodiment, even if the user finishes the movement operation of the trailing end regulator 24 at a position slightly shifted, the trailing end regulator 24 can be moved to the position corresponding to the desired standard size. This movement occurs in a range of ±2 mm from the nominal standard size position in the present embodiment. That is, according to the first embodiment, when the tip 33*a* is distant from the fixing hole for standard size 42 in the range of 2 mm (i.e., a first predetermined distance) in the sheet feeding direction, the tip 33*a* is guided to the fixing hole for standard size 42 by one of the slopes (a slope 33*c*: a first guiding portion) at the tip 33*a* (see FIG. 7). According to the first embodiment, when the tip 33*a* is distant from the fixing hole for standard size 42 in the range of 2 mm (i.e., a second predetermined distance) in the opposite direction of the sheet feeding direction, the tip 33*a* is guided to the fixing hole for standard size 42 by the other of the slopes (a slope 33*d*: a second guiding portion) at the tip 33*a* (see FIG. 7). Since the trailing end regulator 24 is positioned reliably at the desired position for standard size, displacement of the trailing end regulator 24 can be prevented also during the refill of the paper sheets in the cassette 2.

Figure 20:
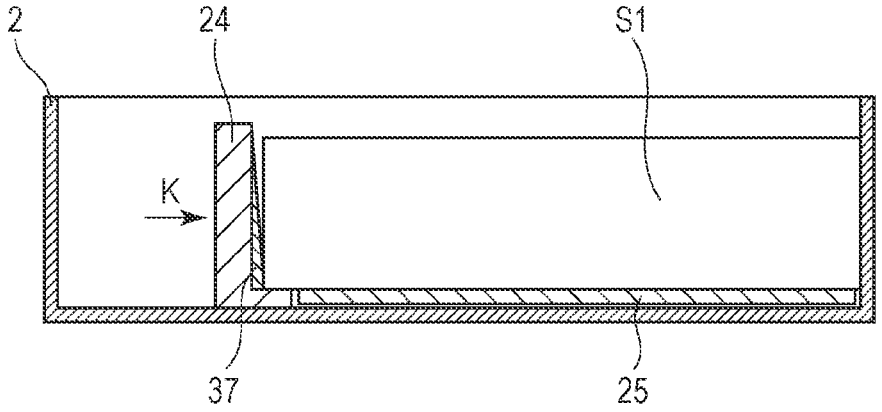
FIG. 20 is a schematic cross-sectional view for illustrating a case where a position of the trailing end regulator is aligned after a paper sheet is placed in the cassette.

Next, a case where the trailing end regulator 24 is operated in accordance with the paper sheet where the paper sheet is previously placed in the cassette 2 is described with reference to a schematic diagram. FIG. 20 illustrates a case in the first embodiment where a paper sheet of nominal length of standard size is placed in the cassette 2, and the trailing end regulator 24 is positioned at an ideal position in accordance with the paper sheet of standard size. The user operates the operation lever 32 of the trailing end regulator 24 to move the trailing end regulator 24 itself in the direction of arrow K. Since the operation lever 32 is operated, the flap plate 37 provided in the trailing end regulator 24 is held while projecting by 2 mm from the nominal position as described above. Then the user releases the operation lever 32 after bringing the flap plate 37 in contact with the paper sheet end surface. Then, the holding state of the flap plate 37 is released, and the flap plate 37 is urged against and in contact with the paper sheet end with appropriate pressure by an unillustrated elastic member. The position of the trailing end regulator 24 at this time is aligned with the nominal position for standard size, and the fixing member for standard size 33 fits into the fixing hole for standard size 42 of the cassette 2. This means that a gap is provided between the paper of standard size of nominal length and the cassette 2, and the length of the gap is 2 mm in the first embodiment.

Since the paper sheet of standard size is subject to manufacturers tolerance of about 1.5 mm to about 2 mm, in order to make it possible to use various kinds of paper in the image forming apparatus, a certain gap is desirably formed between the cassette 2 and the trailing end regulator 24 as in the first embodiment.

If the paper sheet of standard size is shorter than the nominal length by 2 mm, when the user tries to operate the operation lever 32 to make the trailing end regulator 24 abut against the paper sheet, the trailing end regulator 24 stops at a position at which the length of the paper sheet in the longitudinal direction from the nominal position is reduced by 2 mm. When the user releases the operation lever 32 in this state, the trailing end regulator 24 moves in the direction in which the length of the paper sheet in the longitudinal direction is increased, and the tip 33*a* of the fixing member for standard size 33 engages with the fixing hole for standard size 42.

If the paper sheet of standard size is longer than the nominal length by 2 mm, when the user tries to operate the operation lever 32 to make the trailing end regulator 24 abut against the paper sheet, the trailing end regulator 24 stops at a position at which the length of the paper sheet in the longitudinal direction from the nominal position is increased by 2 mm. When the user releases the operation lever 32 in this state, the trailing end regulator 24 moves in the direction in which the length of the paper sheet in the longitudinal direction is reduced, and the tip 33*a* of the fixing member for standard size 33 engages with the fixing hole for standard size 42.

As described above, according to the first embodiment, if the user has unintendedly placed the trailing end regulator 24 at a slightly shifted position before placing the paper sheet, and when the trailing end regulator 24 is pressed against the paper sheet with the paper sheet of standard size is stacked thereon, the trailing end regulator 24 can reliably be placed at the position corresponding to the paper sheet of standard size. That is, since positional misalignment of the trailing end regulator 24 caused by manufacturers tolerance of the paper sheet or incorrect placement by the user can be prevented, accuracy in the fixing position of the trailing end regulator 24 is increased. Therefore, according to the first embodiment, the sheet can be conveyed stably.

According to the first embodiment, the cassette 2 has no gear teeth of the rack gear 43 in the range corresponding to ±2 mm to which the fixing member for standard size 33 is guided (see the FIG. 7) (see FIG. 16). According to the first embodiment, when fixing member for standard size 33 engages with the fixing hole for standard size 42, the fixing member for non-standard size 34 does not engage with the rack gear 43. When the fixing member for non-standard size 34 engages with the rack gear 43, the fixing member for standard size 33 does not engage with the fixing hole for standard size 42. That is, since the trailing end regulator 24 is always positioned at either the position corresponding to the standard size or the position corresponding to the non-standard size, in the range in which the trailing end regulator 24 is movable to regulate the position of the paper sheet end, stable sheet feeding corresponding to the size of paper sheet is possible.

In the foregoing description of the embodiment, the configuration in which the present invention is applied to the trailing end regulator 24 has been described, but the present invention is not limited to the same. For example, the present invention is applicable to width regulation to regulate a paper end position in the width direction.

Second Embodiment

Hereinafter, a second embodiment is described. In the following description of the second embodiment, the same configuration and operation as those of the first embodiment are not described.

In the first embodiment, a configuration in which, when the trailing end regulator 24 is moved at the position corresponding to the standard size, a gap is provided between the fixing member for non-standard size 34 and the rack gear 43 of the cassette 2 so that movement of the trailing end regulator 24 is not disturbed has been described. A second embodiment is a configuration in which force to guide a fixing member for standard size 33 to a fixing hole for standard size 42 is generated even between a fixing member for non-standard size 34 and a cassette 2.

Figure 21A:
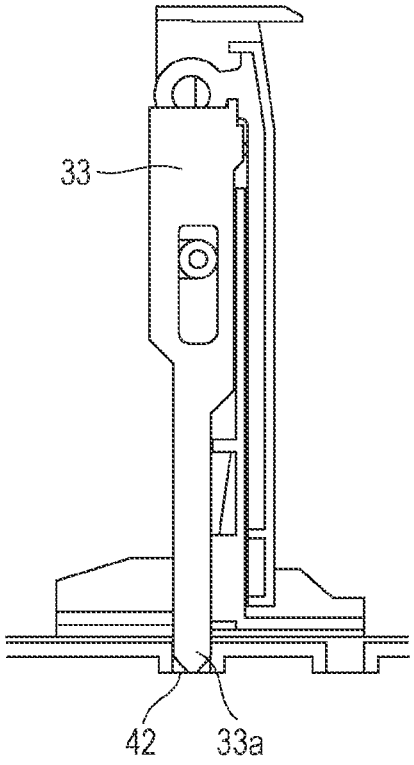
FIG. 21A is a cross-sectional view of a fixing member for standard size of a trailing end regulator in a second embodiment.
Figure 21B:
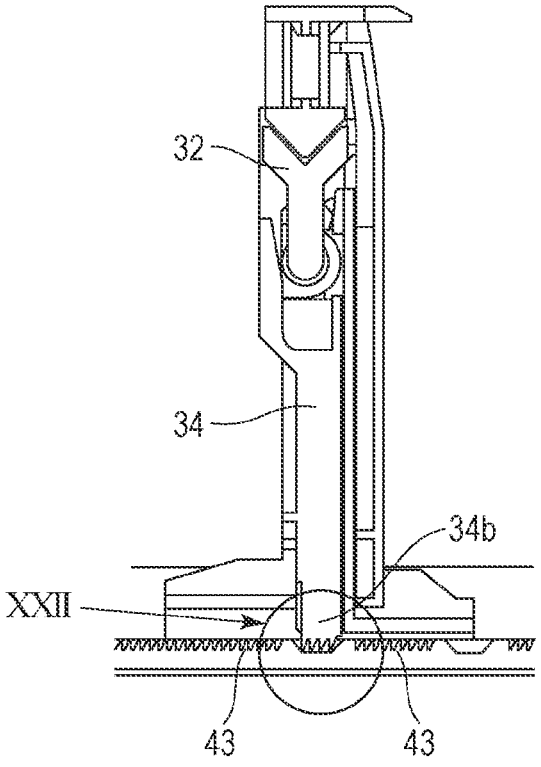
FIG. 21B is a cross-sectional view of the fixing member for standard size of the trailing end regulator in the second embodiment.

FIGS. 21A and 21B illustrate a state where the trailing end regulator 24 is fixed to the position for standard size. A tip 33*a* of the fixing member for standard size 33 fits into the fixing hole for standard size 42 of the cassette 2, and is positioned in the state where trailing end regulator 24 does not move in the conveyance direction of a paper sheet. As in the first embodiment, two fixing members are pressed and urged downward in FIGS. 21A and 21B by elastic members 36, and engage with a V-shaped tip 32*b* of an operation lever 32, whereby their positions in the up-down direction are determined. However, while a tip 34*b* of the fixing member for non-standard size 34 is located in a region where no rack gear 43 of the cassette 2 is formed, the tip 34*b* is stopped at a recess between a slope 2*a* and a slope 2*b* of the cassette 2. That is, the second embodiment differs from the first embodiment in that the cassette 2 has the slopes 2*a* and 2*b* for guiding the tip 34*b* of the fixing member for non-standard size 34.

Figure 22:
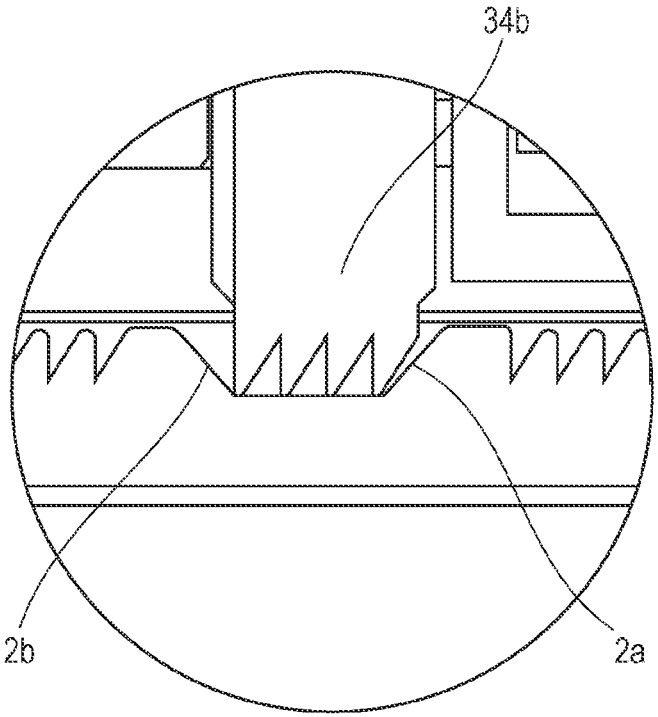
FIG. 22 is an enlarged view of a fixing member for non-standard size of the trailing end regulator according to the second embodiment.

FIG. 22 is an enlarged view of an engaging portion between the fixing member for non-standard size 34 and the cassette 2. The shape of the tip 34*b* of the fixing member for non-standard size 34 is the same as that of the first embodiment. As illustrated in FIG. 22, in the second embodiment, the operation to move the trailing end regulator 24 to the position corresponding to standard size is performed not only on the fixing member for standard size 33 side but on the fixing member for non-standard size 34 side.

Figure 23:
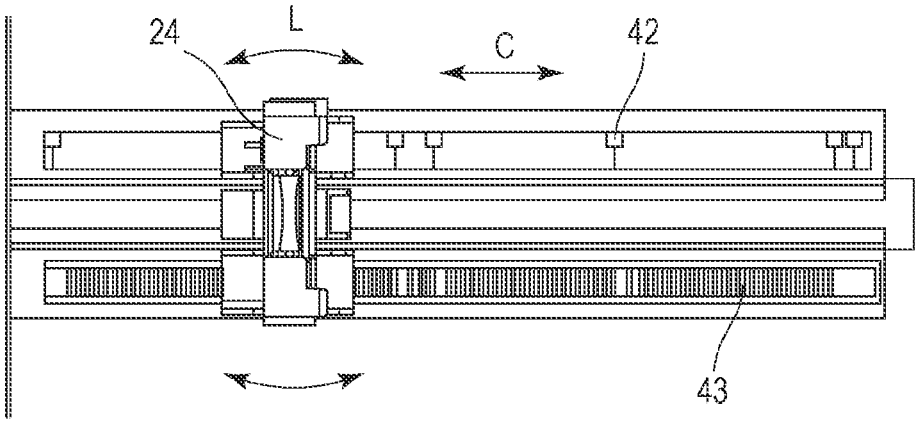
FIG. 23 is a plan view of a cassette according to the second embodiment.

FIG. 23 is a plan view of the cassette 2 of the second embodiment seen from above. As described in the first embodiment, the trailing end regulator 24 is movable in the direction of arrow C. According to the second embodiment, when the trailing end regulator 24 is moved to the nominal position by the urging force of the elastic member 36 from the position shifted from the nominal position, force can be generated at both ends of the trailing end regulator 24 (i.e., in both the fixing member for standard size 33 and the fixing member for non-standard size 34). Therefore, according to the second embodiment, twisting backlash of the trailing end regulator 24 in the direction of arrow L can be reduced.

According to the second embodiment, backlash in the twisting direction of the trailing end regulator 24 is reduced and the force to move the trailing end regulator 24 to the position corresponding to the standard size is further enhanced. That is, according to the second embodiment, accuracy in the position of the trailing end regulator 24 is increased, and stable sheet conveyance becomes possible.

Third Embodiment

Figure 24A:
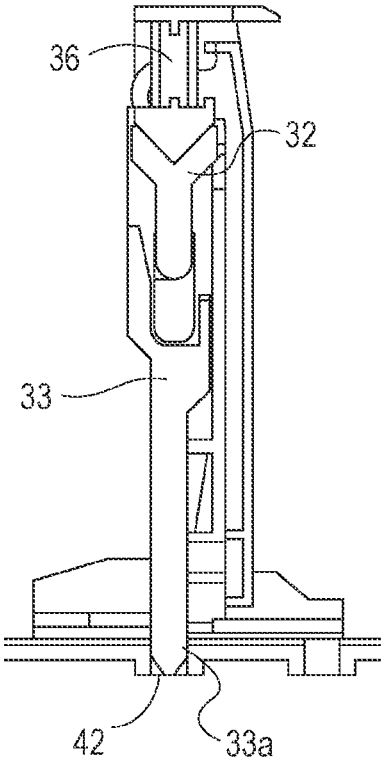
FIG. 24A is a cross-sectional view of two fixing members of a trailing end regulator in a third embodiment.
Figure 24B:
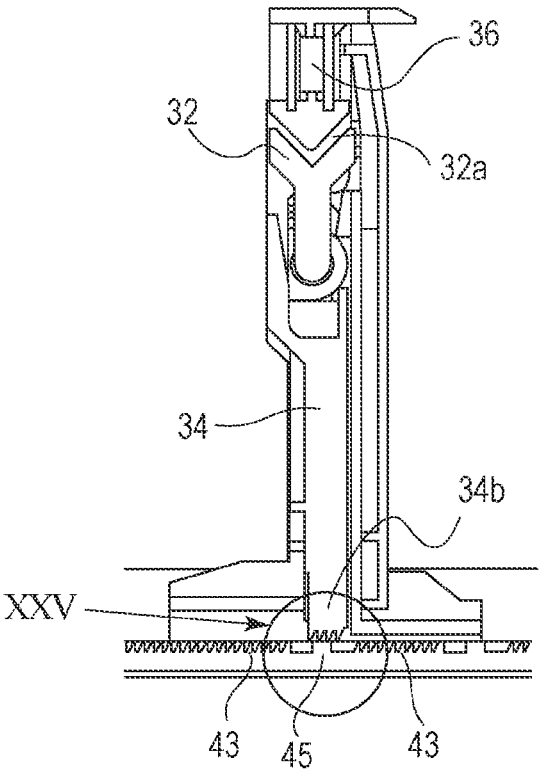
FIG. 24B is a cross-sectional view of the two fixing members of the trailing end regulator in the third embodiment.
Figure 25:
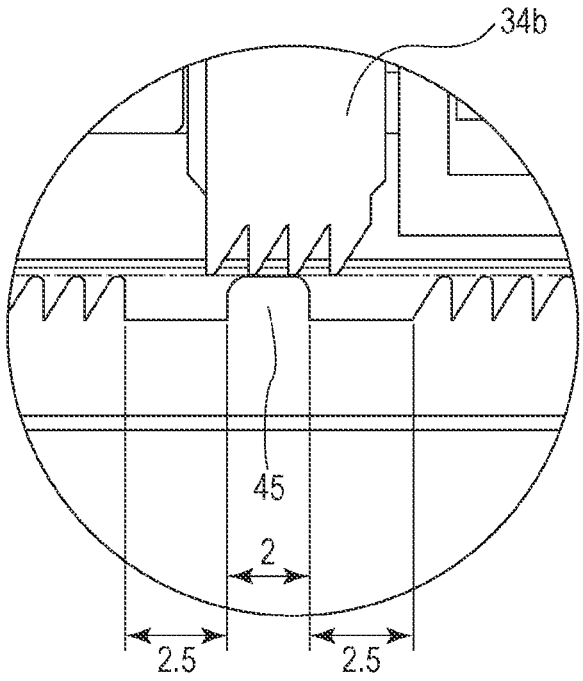
FIG. 25 is an enlarged view of a state where a fixing member for non-standard size engages with a rib in the third embodiment.
Figure 26:
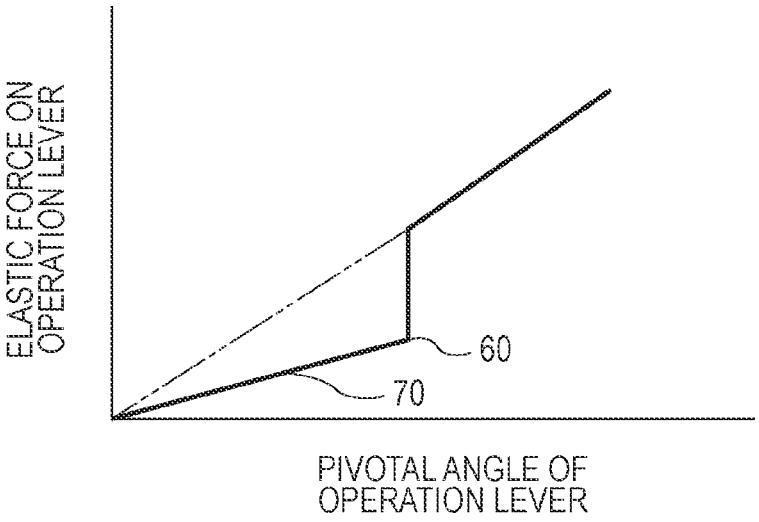
FIG. 26 illustrates operation force of an operation lever.
Figure 27:
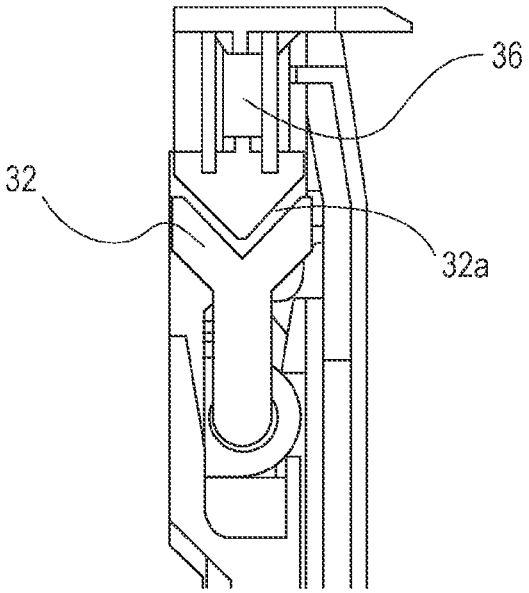
FIG. 27 illustrates a gap between the fixing member for non-standard size and the operation lever in the third embodiment.
Figure 28:
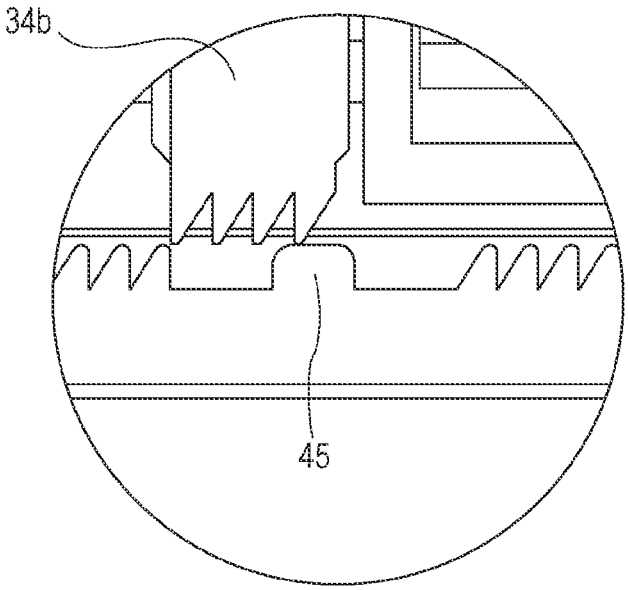
FIG. 28 is an enlarged view illustrating a state in which the fixing member for non-standard size engages with the rib in the third embodiment.
Figure 29:
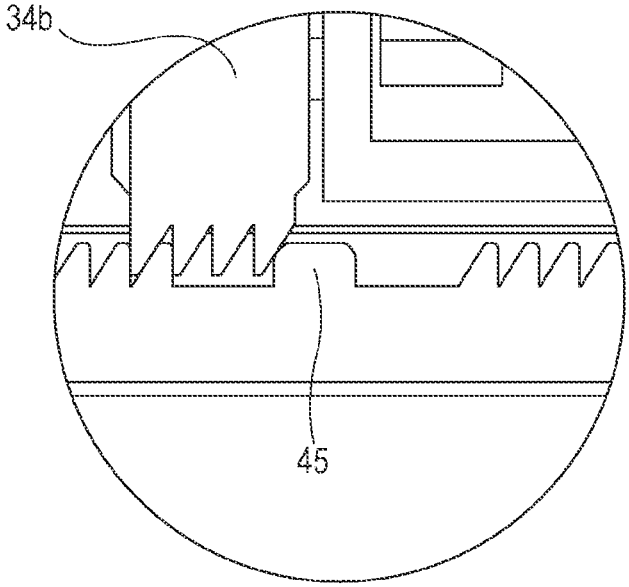
FIG. 29 illustrates a state where a gear tooth of the fixing member for non-standard size engages with a rack gear in the third embodiment.
Figure 30:
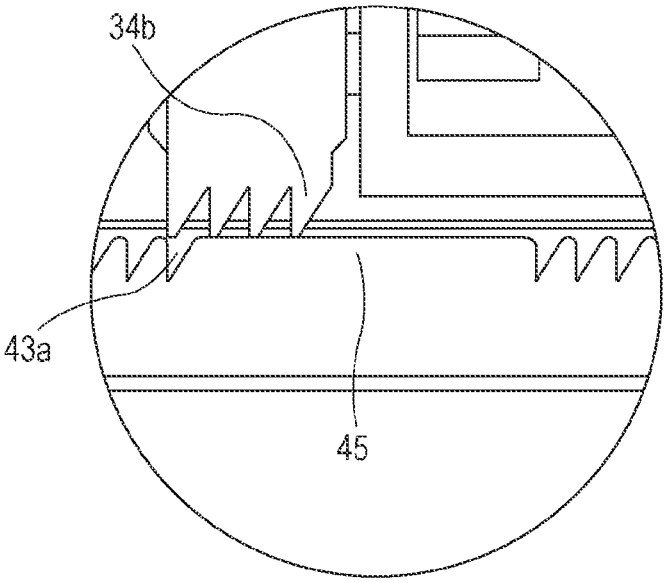
FIG. 30 illustrates a modification of the third embodiment.
Figure 31:
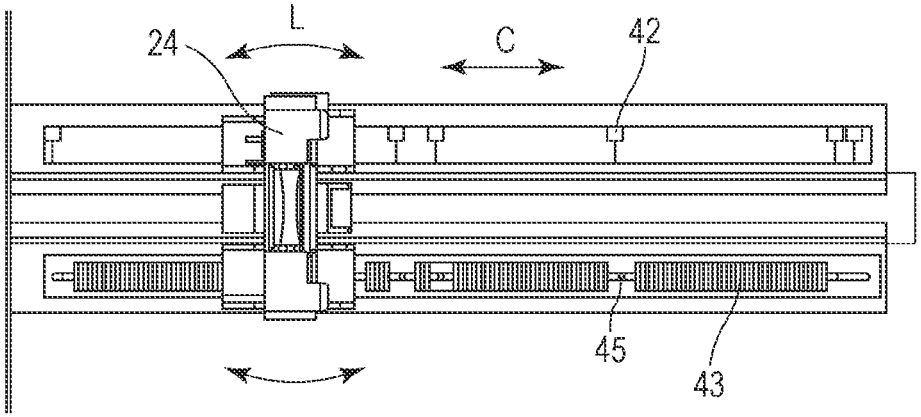
FIG. 31 is a plan view of the cassette in the third embodiment.
Figure 32:
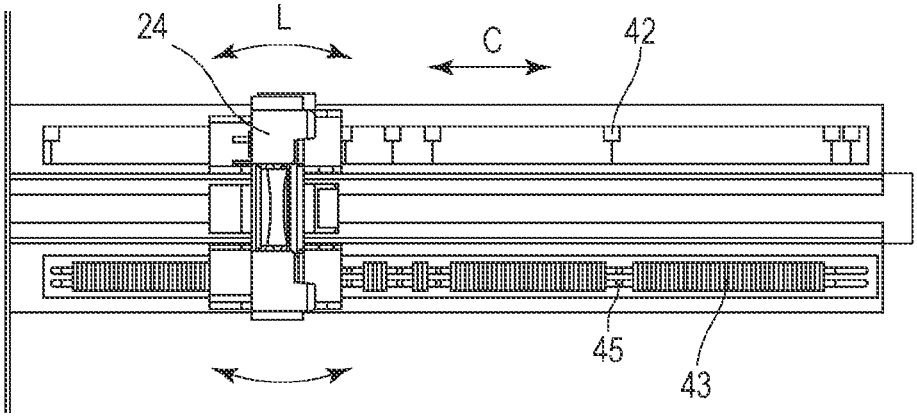
FIG. 32 illustrates a configuration in which two ribs are disposed in the third embodiment.

Hereinafter, a third embodiment is described. In the following description of the third embodiment, the same configuration and operation as those of the first and the second embodiments are not described. In the first embodiment, a configuration in which a flat groove portion is provided in the cassette 2 where the position of the trailing end regulator 24 is in the range of ±2 mm from the nominal position of the standard size in the conveyance direction of the paper sheet (i.e., the region in which no rack gear 43 is provided) is described. The third embodiment is a configuration in which a rib (i.e., a projecting portion) 45 that lifts a fixing member for non-standard size 34 upward is provided at least partially in an area in which no rack gear 43 is provided. The rib 45 lifts the fixing member for non-standard size 34 to a higher level than the lowermost surfaces of grooves of the rack gear 43. The effect of the rib 45 is described hereinafter. FIG. 24A illustrates a state where a trailing end regulator 24 is fixed to the position corresponding to the standard size. Since a tip 33*a* of a fixing member for standard size 33 fits into a fixing hole for standard size 42 of the cassette 2, the trailing end regulator 24 is fixed and held in a state not to be moved in the conveyance direction of the paper sheet. In this state, both the fixing member for standard size 33 and the fixing member for non-standard size 34 are pressed and urged downward in FIGS. 24A and 24B by the elastic member 36. The fixing member for standard size 33 engages with the V-shaped tip of the operation lever 32, whereby the position of the fixing member for standard size 33 in the up-down direction is determined. As illustrated in FIG. 24B, the fixing member for non-standard size 34 is in contact with the rib 45 of the cassette 2 which is a part of the features of the third embodiment, whereby the position of the fixing member for non-standard size 34 in the up-down direction is determined. FIG. 25 is an enlarged sectional view of a portion near the rib 45. The rib 45 is (substantially) the same height as that of a tooth tip (i.e., a top portion, the maximum external line of the rack gear 43 on the trailing end regulator 24 side) of the rack gear 43. In the third embodiment, the width (i.e., the length in the direction in which the trailing end regulator 24 moves) of the rib 45 is 2 mm, and a gap between the rib 45 and the rack gear 43 in the conveyance direction is about 2.5 mm. Next, operation force of the operation lever 32 is described with reference to FIG. 26. In FIG. 26, the horizontal axis represents a pivotal angle of the operation lever 32, and the vertical axis represents the magnitude of the elastic force (i.e., the pressure force) which the operation lever 32 receives from the elastic member 36. In the state where the fixing member for standard size 33 fits into the fixing hole for standard size 42, In the first embodiment, both the fixing member for standard size 33 and the fixing member for non-standard size 34 engage with the V-shaped tip 32*b* of the operation lever 32, whereby the positions of the fixing member for standard size 33 and the fixing member for non-standard size 34 in the up-down direction are determined. At this time, the operation lever 32 receives pressure force of two elastic members 36 that urge the fixing member for standard size 33 and the fixing member for non-standard size 34 downward. Therefore, when the user operates the operation lever 32 to move the trailing end regulator 24, depending on the operation pivotal angle of the operation lever 32, restoring force with which the operation lever 32 tries to return to the original position by the elastic members 36 becomes large (illustrated by the dash-dot-dot line in FIG. 26). In the third embodiment, in the state where the fixing member for standard size 33 fits into the fixing hole for standard size 42, the position of the fixing member for non-standard size 34 in the up-down direction is determined while being lifted by the rib 45. At this time, a predetermined gap 32*a* is formed between the fixing member for non-standard size 34 and the operation lever 32 (see FIG. 27). In this state, only the elastic force of the elastic member 36 on the side of the fixing member for standard size 33 acts on the operation lever 32, and the elastic force of the elastic member 36 on the side of the fixing member for non-standard size 34 does not act on the operation lever 32. Therefore, the operation force with which the user moves the trailing end regulator 24 when operating the operation lever 32 is smaller than that of the first embodiment initially because no elastic force on the side of the fixing member for non-standard size 34 is acting. The region in which the operation force is small is a region 70 in FIG. 26. Then, as the user further makes the operation lever 32 pivot, the fixing member for non-standard size 34 is lifted and is made to engage with the operation lever 32. Therefore, after a point 60, restoring force by the elastic member 36 on the side of the fixing member for non-standard size 34 also acts on the operation lever 32 (illustrated by the solid line in FIG. 26). According to the third embodiment, as described above, the operation force of the operation lever 32 is further reduced as compared with the first embodiment. The point 60 at which the operation force of the operation lever 32 changes is substantially the same as the timing at which the tip 33*a* of the fixing member for standard size 33 is lifted from the fixing hole for standard size 42 and fixation of the position of the trailing end regulator 24 is released. Therefore, according to the third embodiment, the user easily feels the change of the operation force of the operation lever 32, and the transition of the state of the trailing end regulator 24 from the fixed state into the movable state. In the state in which the trailing end regulator 24 is located in the region near the position corresponding to position of standard size, the fixing member for non-standard size 34 is in contact with the rib 45 but does not engage with the rack gear 43. Therefore, the third embodiment has, as well as the first and the second embodiments, an effect that the trailing end regulator 24 is moved from the position slightly shifted from the position corresponding to standard size to the position corresponding to standard size. This is described with reference to FIG. 28. FIG. 28 illustrates the state where the user has placed the trailing end regulator 24 at a position at which the length of the paper sheet in the longitudinal direction from the nominal position is increased by 2 mm from the position corresponding to standard size. The fixing member for standard size 33 at this time is in the state illustrated in FIG. 18A of the first embodiment, and the tip 33*a* is about to fit into the fixing hole for standard size 42 by the elastic force of the elastic member 36. The fixing member for non-standard size 34 and the rack gear 43 do not engage with each other as illustrated in FIG. 28. Therefore, the fixing member for standard size 33 is guided to fit into the fixing hole for standard size 42 by the elastic force of the elastic member 36, and the rib 45 does not disturb the movement. FIG. 29 illustrates a state where the user has placed the trailing end regulator 24 at a position shifted by a greater amount than 2.0 mm in the longitudinal direction of the paper sheet from the position corresponding to standard size (i.e., the nominal position). Since a gear tooth among a plurality of gear teeth of the fixing member for non-standard size 34 engages with the rack gear 43 at this time, the trailing end regulator 24 is fixed. That is, since the rib 45 is provided at a part of the region in which no rack gear 43 is provided, only a single gear tooth of the fixing member for non-standard size 34 and the rack gear 43 can engage with each other. When the fixing member for non-standard size 34 is moved to the left in FIG. 29 from the state of FIG. 29, a plurality of gear teeth of the fixing member for non-standard size 34 engage with the rack gear 43. Thus, if the shift amount of the trailing end regulator 24 from the nominal position is 2.0 mm or smaller, the fixing member for standard size 33 is moved to the nominal position and fits into the fixing hole for standard size 42 by the effect of the fixing member for standard size 33. If, on the other hand, the shift amount of the trailing end regulator 24 from the nominal position is greater than 2.0 mm, the position of the trailing end regulator 24 can be fixed when at least one gear tooth of the fixing member for non-standard size 34 engages with the rack gear 43. That is, the position of the trailing end regulator 24 is always fixed by either the fixing member for standard size 33 or the fixing member for non-standard size 34. FIG. 30 illustrates a modification of the third embodiment. This modification is a configuration in which the rib 45 is provided in the entire width of the area in which no rack gear 43 is provided. FIG. 30 illustrates the state where the trailing end regulator 24 is placed at a position shifted by 3.0 mm from the nominal position in the longitudinal direction of the paper sheet. The tip 34*b* of the fixing member for non-standard size 34 is in contact with a top surface of the rib 45, and does not engage with the rack gear 43. Further, the fixing member for standard size 33 is in the state of FIG. 17A in the first embodiment, and does not fit into the fixing hole for standard size 42. Therefore, in this modification, in order to cause the tip 34*b* of the fixing member for non-standard size 34 to engage with a rack gear 43*a*, the position of the trailing end regulator 24 needs to be further moved 3.0 mm in the longitudinal direction of the paper sheet. That is, in this modification, as illustrated in FIG. 30, a state where the trailing end regulator 24 cannot be fixed may occur. This state may cause poor conveyance of the paper sheet, and the like and therefore is desirably reduced as much as possible. Therefore, in the third embodiment, a 2.5-mm gap is formed between the rib 45 and the rack gear 43 and, in the range where the trailing end regulator 24 is movable, the position of the trailing end regulator 24 is fixed by either the fixing member for standard size 33 or the fixing member for non-standard size 34. That is, the configuration of the third embodiment is superior to the configuration of the modification. This does not exclude the configuration of the modification from the present invention. According to the third embodiment, as described above, usability during the movement of the trailing end regulator 24 from the nominal position to the position of another size is improved (i.e., operation force is reduced) without impairing accuracy in fixing the trailing end regulator 24. Although a single rib 45 is disposed at the center of the area where no rack gear 43 is provided in the third embodiment as illustrated in FIG. 31, two ribs 45 may be provided as illustrated in FIG. 32 in the present invention. Alternatively, two or more ribs 45 may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A stacking apparatus comprising:

a sheet stacking plate on which sheets are to be stacked;

a cassette main body configured to support the sheet stacking plate;

a regulating device disposed at the cassette main body to be movable in a first direction and a second direction opposite to the first direction, and configured to regulate an end position of the sheets wherein the regulating device includes a holding member, a boss, a first spring, a second spring, and an operation member configured to rotate with respect to the holding member using the boss and configured to be operated;

a plurality of first engaged portions disposed at the cassette main body in a moving direction of the regulating device; and a plurality of second engaged portions disposed at the cassette main body in the moving direction of the regulating device, wherein the plurality of second engaged portions are arranged at positions separated from the plurality of first engaged portions with respect to a direction intersecting the moving direction of the regulating device, a distance between an adjacent second engaged portion and a second engaged portion in the moving direction of the regulating device is greater than a distance between an adjacent first engaged portion and a first engaged portion in the moving direction of the regulating device, wherein the regulating device further includes:

a first engaging portion movable in a first vertical direction and configured to engage with the plurality of first engaged portions by being urged by the first spring, a second engaging portion movable in a second vertical direction and configured to engage with the plurality of second engaged portions by being urged by the second spring, wherein a downward movement in the second vertical direction is suppressed in a state where the second engaging portion is in contact with a contact portion by the second spring, and an urging portion provided at the operation member and configured to urge the first engaging portion, wherein the urging portion moves the first engaging portion in an upward direction by rotating the operation member, and wherein, with respect to the first vertical direction, the boss, the urging portion and the first engaging portion are placed side by side in that order.

2. The stacking apparatus according to claim 1, wherein the urging portion includes a slope.

3. The stacking apparatus according to claim 1, wherein the regulating device is positioned with regard to the cassette main body by the first engaging portion engaging with the plurality of first engaged portions.

4. The stacking apparatus according to claim 3, wherein, in a case where the sheets are stacked on the sheet stacking plate, the regulating device regulates the end position of the sheets stacked on the sheet stacking plate.

5. The stacking apparatus according to claim 3, wherein, in a case where the sheets are stacked on the sheet stacking plate, the regulating device regulates the end position of the sheets stacked on the sheet stacking plate in a width direction.

6. The stacking apparatus according to claim 1, wherein the operation member is an operation lever pivotally held about a pivotal axis such that, when a user engages the operation lever located at a retracted position to perform an operation to pivot to the operation lever to an operative position, a position of the regulating device can be moved.

7. The stacking apparatus according to claim 6, wherein the position of the regulating device can be moved when a hand of the user engages the operation lever located at the retracted position.

8. The stacking apparatus according to claim 1, wherein the second spring is disposed on the second engaging portion.

9. The stacking apparatus according to claim 1, wherein the operation member and the boss are constructed integrally.

* * * * *